US008642236B2

(12) United States Patent
Hamasaki et al.

(10) Patent No.: US 8,642,236 B2
(45) Date of Patent: Feb. 4, 2014

(54) ELECTRO PHOTOGRAPHIC PHOTOCONDUCTOR AND COLOR IMAGE FORMING APPARATUS

(75) Inventors: Kazunari Hamasaki, Osaka (JP); Yuko Iwashita, Osaka (JP); Yukimasa Watanabe, Osaka (JP)

(73) Assignee: Kyocera Mita Corporation (JP)

( * ) Notice: Subject to any disclaimer, the term of this patent is extended or adjusted under 35 U.S.C. 154(b) by 819 days.

(21) Appl. No.: 12/021,392

(22) Filed: Jan. 29, 2008

(65) Prior Publication Data

US 2008/0187847 A1 Aug. 7, 2008

(30) Foreign Application Priority Data

Feb. 7, 2007 (JP) ..... 2007-028447

(51) Int. Cl.
*G03G 15/00* (2006.01)

(52) U.S. Cl.
USPC ..... 430/56; 399/159

(58) Field of Classification Search
USPC ..... 430/56; 399/159
See application file for complete search history.

(56) References Cited

U.S. PATENT DOCUMENTS

| | | | | |
|---|---|---|---|---|
| 5,945,243 | A * | 8/1999 | Nakamura et al. | 430/83 |
| 2003/0035660 | A1 * | 2/2003 | Sugino et al. | 399/111 |
| 2003/0059696 | A1 * | 3/2003 | Nabeta et al. | 430/96 |
| 2004/0033430 | A1 * | 2/2004 | Sekine et al. | 430/76 |
| 2004/0234875 | A1 * | 11/2004 | Toda et al. | 430/58.7 |
| 2006/0160005 | A1 * | 7/2006 | Kuboshima et al. | 430/96 |
| 2009/0317733 | A1 * | 12/2009 | Okura et al. | 430/56 |

FOREIGN PATENT DOCUMENTS

| | | | |
|---|---|---|---|
| JP | 09-138516 | A | 5/1997 |
| JP | 2002341603 | | 11/2002 |
| JP | 2003107759 | | 4/2003 |
| JP | 2005-043593 | | 2/2005 |
| JP | 200610824 | | 1/2006 |
| JP | 2006171596 | | 6/2006 |
| WO | WO 2007083652 | * | 7/2007 |

* cited by examiner

*Primary Examiner* — Mark F Huff
*Assistant Examiner* — Rachel Zhang
(74) *Attorney, Agent, or Firm* — Gerald E. Hespos; Michael J. Porco; Matthew T. Hespos

(57) ABSTRACT

Provided are an electrophotographic photoconductor which shows a small variation in sensitivity and exhibits a high sensitivity even at a small amount of light exposure and a tandem-system color image forming device provided with the electrophotographic photoconductor. A positive charging type electrophotographic photoconductor for use in a tandem-system color image forming device including a drum type electrophotographic photoconductor, a rotation speed of which is (70) rpm or more, and a color image forming device provided with the electrophotographic photoconductor, wherein, when Vb (V) denotes a sensitivity in the case where an amount of light exposure per unit area is 0.6 μJ/cm$^2$ and Va (V) denotes a sensitivity in the case where an amount of light exposure per unit area is 1.5 μJ/cm$^2$, a sensitivity ratio represented by Vb/Va is adjusted to a value of below (2).

10 Claims, 6 Drawing Sheets

ELECTRO PHOTOGRAPHIC PHOTOCONDUCTOR AND COLOR IMAGE FORMING APPARATUS

BACKGROUND OF THE INVENTION

1. Field of the Invention

The present invention relates to an electrophotographic photoconductor and a color image forming device. In particular, it relates to an electrophotographic photoconductor which shows a small variation in sensitivity and exhibits a high sensitivity even at a small light exposure and a tandem-system color image forming device provided therewith.

2. Description of the Related Art

Heretofore, color image forming devices using an endless belt-shaped rotating member entrained on a plurality of rollers have been proposed (see, for example, patent document 1).

In such an image forming device, an intermediate transfer body for primarily transferring a toner image formed on an image carrier by an electrophotographic system and then secondarily transferring the image to a transfer material is constituted from a belt-shaped rotating member (intermediate transfer belt). A tandem system is adopted that has a color printing function to form color images by superimposing toners of a plurality of colors such as yellow (Y), magenta (M), cyan (C) and black (K), on an intermediate transfer belt. Therefore, in such a color image forming device, developing devices each corresponding to an individual color are arranged along the intermediate transfer belt in order to superimpose toners of a plurality of colors.

On the intermediate transfer belt, toner images of four colors, namely YMCK, are transferred (primarily transferred) one after another so that they are superimposed one on another by each photoconductor drum of the developing device and thereby a color image is formed. Furthermore, the color image formed on the intermediate transfer belt is transferred (secondarily transformed) onto a transfer material such as a paper sheet by a secondary transfer roller arranged facing the intermediate transfer belt, thereby forming a predetermined color image. [Patent document 1] JP-2005-43593A (Claims)

In the color image forming device disclosed in patent documents 1, however, variation in sensitivity easily occurs among four electrophotographic photoconductors corresponding to the above-mentioned four-color toner development and there is a problem that it is difficult to form favorable images.

In particular, when the rotation speed of an electrophotographic photoconductor is a predetermined value or more, for example 70 rpm or more, or when the electrophotographic photoconductor to be mounted has an outer diameter of 30 mm or less, the exposure/development times become shortened and the amount of light exposure decreases. For this reason, there is a problem that the variation in sensitivity among the four electrophotographic photoconductors occurs extremely easily.

Under such circumstances, attempts have been made to improve print properties of color images by increasing the light exposure strength. However, there are further problems that the light degradation of electrophotographic photoconductors are promoted, resulting in great deterioration of durability or the cost or scale of exposure devices increases.

Therefore, an appropriate parameter for making the variations in sensitivity uniform among four electrophotographic photoconductors has been demanded, but only the sensitivity has been standardized according to the value of light potential or the like.

SUMMARY OF THE INVENTION

As a result of diligent researches, the present inventors have accomplished the present invention based on the following finding. That is, in an electrophotographic photoconductor provided in a tandem-system color image forming device, the ratio of the sensitivities is controlled, which is measured on irradiation of at least two predetermined amounts of light exposure (per unit area). This makes it possible to effectively regulate and control the variation in sensitivity among four electrophotographic photoconductors even when the exposure/development times are shortened and also possible to obtain a high sensitivity.

An object of the present invention is to provide an electrophotographic photoconductor which shows a small variation in sensitivity and exhibits a high sensitivity even when the photoconductor is mounted in a tandem-system color image forming device and image formation is performed at a high speed, and also to provide an image forming device provided therewith.

According to an embodiment of the present invention provided is a positive charging type electrophotographic photoconductor for use in a tandem type color image forming device including a drum type electrophotographic photoconductor, a rotation speed of which is 70 rpm or more, wherein, when Vb (V) denotes a sensitivity in the case where an amount of light exposure per unit area is 0.6 $\mu J/cm^2$ and Va (V) denotes a sensitivity in the case where an amount of light exposure per unit area is 1.5 $\mu J/cm^2$, the sensitivity ratio represented by Vb/Va is adjusted to a value of below 2. This can solve the above-mentioned problems.

That is, by controlling the ratio of the sensitivities measured on irradiation of at least two predetermined amounts of light exposure (per unit area), it is possible to effectively regulate and control the variation in sensitivity among a plurality of electrophotographic photoconductors even when the exposure/development times are shortened and also possible to obtain a high sensitivity.

Adoption of the positive charging type reduces the degradation of the photosensitive layer by ozone. As a result, variation in sensitivity among a plurality of electrophotographic photoconductors can be controlled more efficiently.

Therefore, even when it is mounted in a tandem-system color image forming device and image formation is performed at high speed, it is possible to form a high quality color image with a stable image density.

In constituting the electrophotographic photoconductor of the invention, it is preferable to adjust the sensitivity (Vb) at an amount of light exposure per unit area of 0.6 $\mu J/cm^2$ to a value of 150 V or less.

By adopting such a constitution, it is possible to certainly obtain a high sensitivity even when the amount of light exposure is small.

In constituting the electrophotographic photoconductor of the invention, it is preferable to adjust the sensitivity (Va) at an amount of light exposure per unit area of 1.5 $\mu J/cm^2$ to a value within the range from 70 to 120 V.

Adopting such a constitution enables to easily control the variation in sensitivity between a plurality of photoconductors even when the amount of light exposure substantially varies.

In constituting the electrophotographic photoconductor of the invention, it is preferable to adjust the outer diameter to a value within the range from 10 to 30 mm.

Adoption of such a constitution can contribute to miniaturization and weight reduction of electrophotographic photoconductors. When the outer diameter becomes small, the number of rotations of the electrophotographic photoconductor will increase. In the electrophotographic photoconductor of the invention, however, it is possible to control variation in sensitivity among a plurality of electrophotographic photoconductors and also possible to obtain a high sensitivity.

In constituting the electrophotographic photoconductor of the invention, it is preferable that the electrophotographic photoconductor is a monolayer-type organic photoconductor having a photosensitive layer comprising a polycarbonate resin having a viscosity average molecular weight of from 20,000 to 80,000, wherein the thickness of the photosensitive layer is adjusted to a value within the range from 5 to 50 μm.

Adopting such a constitution enables more effective control of the occurrence of variation in sensitivity among a plurality of electrophotographic photoconductors due to the light degradation of a photosensitive layer, the degradation by a mechanical external force, etc.

Another embodiment of the present invention is a tandem-system color image forming device including a drum type electrophotographic photoconductor, a rotation speed of which is 70 rpm or more, wherein the color image forming device is provided with a positive charging type electrophotographic photoconductor and when Vb (V) denotes a sensitivity in the case where an amount of light exposure per unit area of the electrophotographic photoconductor is 0.6 $\mu J/cm^2$ and Va (V) denotes a sensitivity in the case where an amount of light exposure per unit area is 1.5 $\mu J/cm^2$, the sensitivity ratio represented by Vb/Va is adjusted to a value of below 2.

That is, the image forming device of the invention is provided with the above-mentioned electrophotographic photoconductor, whereby the image forming device can effectively regulate and control the variation in sensitivity among a plurality of electrophotographic photoconductors even when the exposure/development times are shortened and also can obtain a high sensitivity.

Therefore, even when image formation is performed at a high speed, a high quality color image with a stable image density can be formed.

In constituting the color image forming device of the invention, it is desirable to adjust the process speed to a value within the range from 80 to 200 mm/sec.

With such a constitution, it is possible to perform image formation at high speed to improve the image formation efficiency. When the process speed is increased, the exposure/development times are shortened. However, by use of the electrophotographic photoconductor of the invention, it is possible to control the variation in sensitivity among a plurality of electrophotographic photoconductors and also possible to obtain a high sensitivity.

In constituting the color image forming device of the invention, the device is preferably in a cleaner-less system.

Adoption of such a constitution in which cleaner blades or the like are omitted can contribute to miniaturization and weight reduction of color image forming devices.

In the case of a conventional color image forming device, adoption of a cleaner-less system causes a large amount of toner to remain on an electrophotographic photoconductor, with the result that substantial variation in the amount of light exposure tends to occur. However, the electrophotographic photoconductor of the invention can control the variation in sensitivity among a plurality of electrophotographic photoconductors, even if it is in a cleaner-less system (neglecting system of cleaning device). Therefore, a high sensitivity can be obtained even when a large amount of toner remains on an electrophotographic photoconductor and, as a result, the amount of light exposure varies.

DETAILED DESCRIPTION OF THE PREFERRED EMBODIMENTS

First Embodiment

Figure 1:
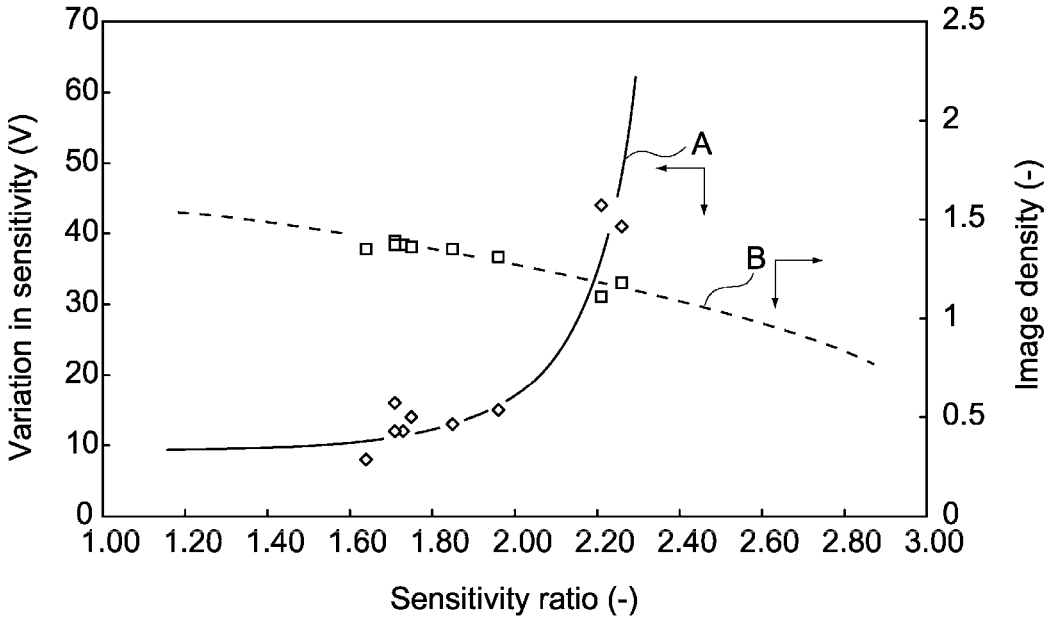
FIG. 1 is a graph for illustrating a relationship among a sensitivity ratio, a variation in sensitivity and an image density.

A first embodiment is a positive charging type electrophotographic photoconductor for use in a tandem type color image forming device including a drum type electrophotographic photoconductor, a rotation speed of which is 70 rpm or more, wherein, when Vb (V) denotes a sensitivity in the case where an amount of light exposure per unit area is 0.6 $\mu J/cm^2$ and Va (V) denotes a sensitivity in the case where an amount of light exposure per unit area is 1.5 $\mu J/cm^2$, a sensitivity ratio represented by Vb/Va is adjusted to a value of below 2 as shown in FIG. 1.

Electrophotographic photoconductors as the first embodiment will be described specifically by taking a monolayer-type electrophotographic photoconductor as an example.

1. Fundamental Constitution

Figure 2A:
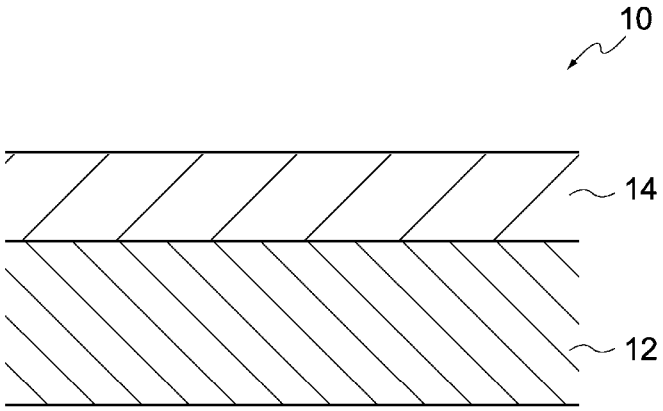
FIGS. 2A and 2B are views for illustrating a fundamental structure of a monolayer-type electrophotographic photoconductor and a modified structure thereof.

As shown in FIG. 2A, a monolayer-type photoconductor 10 comprises a base body 12 and a single photosensitive layer 14 disposed thereon.

Such a photosensitive layer contains a binding resin, a hole transfer agent, an electron transfer agent, and a charge generating agent and may, if necessary, further contain additives, such as a leveling agent or a silyl group-containing compound.

Figure 2B:
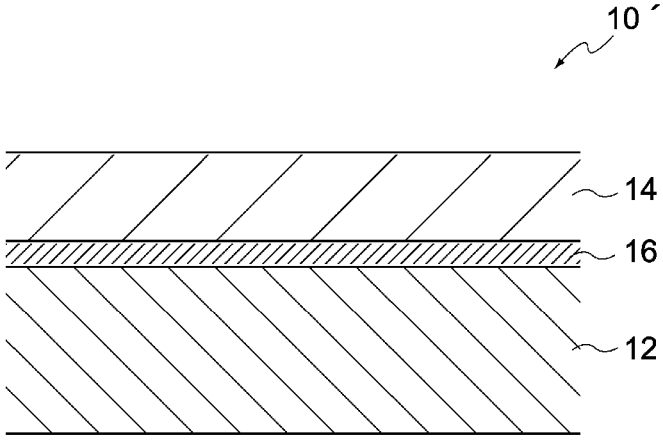

A monolayer-type photoconductor 10' is also available in which a barrier layer 16 is disposed between the base body 12 and the photosensitive layer 14 as shown in FIG. 2B unless the properties of the photoconductor are affected.

It is noted that the electrophotographic photoconductor of the present invention is in a positive charging type.

The reason is that adoption of a positive charging type can reduce the degradation of a photosensitive layer caused by ozone generating mainly at the time of negative charging and therefore it can contribute to controlling the variation in sensitivity among a plurality of electrophotographic photoconductors.

Various electroconductive materials may be used as the base body, and examples thereof include metals, such as iron, aluminum, copper, tin, platinum, silver, vanadium, molybdenum, chromium, cadmium, titanium, nickel, palladium, indium, stainless steel and brass, plastic materials on which metal, such as those mentioned above, has been vapor deposited or laminated, glass coated with aluminum iodide, tin oxide, indium oxide or the like, and plastic materials in which conductive particles, such as carbon black, have been dispersed.

2. Photosensitive Layer (1) Binding Resin (1)-1 Kind

The kind of the binding resin to be used for the electrophotographic photoconductor of the invention is not particularly restricted. For example, available resins include thermoplastic resins such as a polycarbonate resin, a polyester resin, a polyallylate resin, a styrene-butadiene copolymer, a styrene-acrylonitrile copolymer, a styrene-maleic acid copolymer, an acrylic copolymer, a styrene-acrylic acid copolymer, polyethylene, an ethylene-vinyl acetate copolymer, chlorinated polyethylene, polyvinyl chloride, polypropylene, an ionomer, a vinyl chloride-vinyl acetate copolymer, an alkyd resin, polyamide, polyurethane, polysulfone, a diallyl phthalate resin, a ketone resin, a polyvinyl butyral resin and a polyether resin; crosslinkable thermosetting resins such as a silicone resin, an epoxy resin, a phenol resin, an urea resin and a melamine resin; and photo-curing resins such as epoxy-acrylate and urethane-acrylate.

(1)-2 Specific Examples

Among the binding resins mentioned above, use of a polycarbonate resin is particularly preferred. One specific example of such a polycarbonate resin is a polycarbonate resin (Resin-1) represented by the following formula (1).

(1)

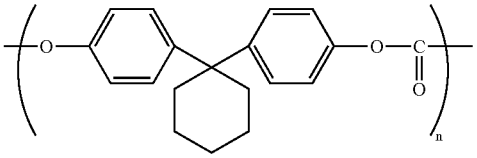

(Resin-1)

(1)-3 Viscosity Average Molecular Weight

It is preferable to adjust a viscosity average molecular weight of the polycarbonate resin to a value within the range from 20,000 to 80,000.

A reason of this is that by adjusting the viscosity average molecular weight of the polycarbonate resin within such a range, it is possible to control more effectively the occurrence of variation in sensitivity among a plurality of electrophotographic photoconductors due to the light degradation of a photosensitive layer, the degradation by a mechanical external force, etc.

More specifically, that is because when the viscosity average molecular weight of the polycarbonate resin becomes a value of below 20,000, it may become difficult to fully control the light degradation of a photosensitive layer and the degradation by a mechanical external force, while on the other hand, when the viscosity average molecular weight of the polycarbonate resin is a value exceeding 80,000, the viscosity of a coating liquid for a photosensitive layer remarkably increases and it may become difficult to form a uniform photosensitive layer.

For such reasons, it is more desirable to adjust the viscosity average molecular weight of the polycarbonate resin to a value within the range from 25,000 to 70,000, and even more desirably to a value within the range from 30,000 to 60,000.

The viscosity average molecular weight of a polycarbonate resin can be calculated according to the Schnell's formula $[\eta]=1.23\times10^{-4}M^{0.83}$ following the measurement of an intrinsic viscosity [η] with an Ostwald viscometer. The [η] can be measured in a polycarbonate resin solution prepared by dissolving a polycarbonate resin at 20° C. in a solvent composed of a methylene chloride solution so that the concentration (C) becomes 6.0 g/dm$^3$.

(2) Hole Transfer Agent (2)-1 Kind

As a hole transfer agent to be used for the electrophotographic photoconductor of the invention, any compound may be used without any restriction as long as the compound can cause a ratio of sensitivities measured at predetermined amounts of light exposure (per unit area) to fall within a predetermined range. All conventional well-known various hole transferring compounds are usable. In particular, preferably used are benzidine compounds, phenylenediamine compounds, naphthylenediamine compounds, phenantolylenediamine compounds, oxadiazole compounds (e.g., 2,5-di(4-methylaminophenyl)-1,3,4-oxadiazole, etc.), styryl compounds (e.g., 9-(4-diethylaminostyryl)anthracene, etc.), carbazole compounds (e.g., poly-N-vinylcarbazole, etc.), organopolysilane compounds, pyrazoline compounds (e.g., 1-phenyl-3-(p-dimethylaminophenyl)pyrazoline, etc.), hydrazone compounds, triphenylamine compounds, indole compounds, oxazole compounds, isooxazole compounds, thiazole compounds, thiadizole compounds, imidazole compounds, pyrazole compounds, triazole compounds, butadiene compounds, pyrene-hydrazone compounds, acrolein compounds, carbazolehydrazone compounds, quinoline-hydrazone compounds, stilbene compounds, stilbene-hydrazone compounds, and diphenyldiamine compounds, etc. These may be used singly or alternatively may be used in combination of two or more thereof.

(2)-2 Specific Examples

Among the hole transferring compounds described above, compounds (HTM-1 to HTM-6) represented by the following formulas (2) to (7) are mentioned as compounds to be used particularly preferably.

(2)

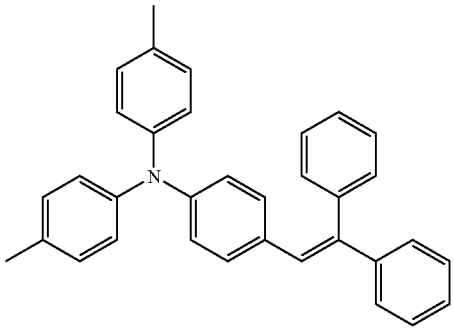

(HTM-1)

(3)

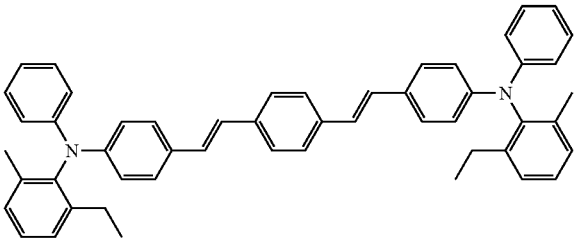

(HTM-2)

-continued (4)

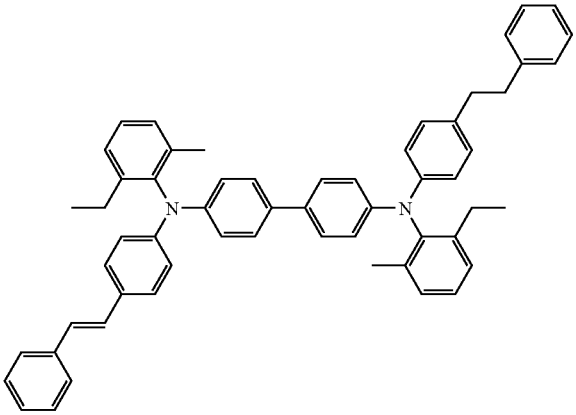

(HTM-3)

(5)

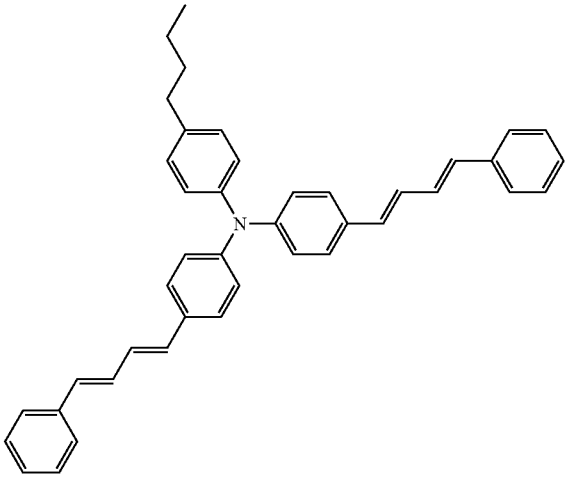

(HTM-4)

(6)

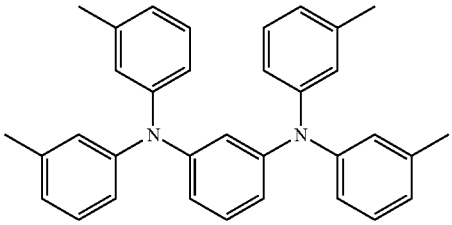

(HTM-5)

-continued (7)

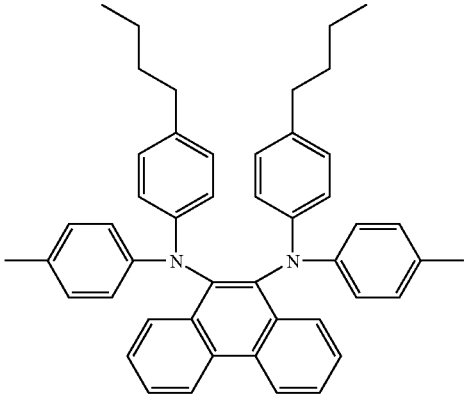

(HTM-6)

(2)-3 Content

It is preferable to adjust the content of the hole transfer agent to a value within the range from 10 to 100 parts by weight based on 100 parts by weight of the binding resin in the photosensitive layer.

A reason of this is that by adjusting the content of the hole transfer agent into such a range, it is possible to effectively prevent the hole transfer agent from crystallizing in the photosensitive layer and also to obtain superior electrical characteristics.

In other words, that is because if the content of the hole transfer agent becomes a value less than 10 parts by weight, problems in practical use may arise due to lowering of sensitivity, while on the other hand, if the content of the hole transfer agent is a value exceeding 100 parts by weight, the hole transfer agent will easily crystallize too much and it may be difficult to form a film proper as a photosensitive layer.

For such reasons, it is more desirable to adjust the content of the hole transfer agent to a value within the range from 20 to 90 parts by weight, and even more desirably to a value within the range from 30 to 80 parts by weight.

(3) Electron Transfer Agent (3)-1 Kind

As the electron transfer agent to be used for the electrophotographic photoconductor of the invention, any compound may be used without any restriction as long as the compound can cause a ratio of sensitivities measured at predetermined amounts of light exposure (per unit area) to fall within a predetermined range. All various conventional electron transferring compounds are usable. Particular examples include a single species or a combination of two or more species selected from diphenoquinone derivatives, pyrene derivatives, benzoquinone derivatives, anthraquinone derivatives, malononitrile derivatives, thiopyran derivative, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, dibromomaleic anhydride and the like.

(3)-2 Specific Examples

Among the electron transferring compounds described above, compounds (ETM-1 to ETM-3) represented by the following formulas (8) to (10) are mentioned as compounds to be used particularly preferably.

(8)

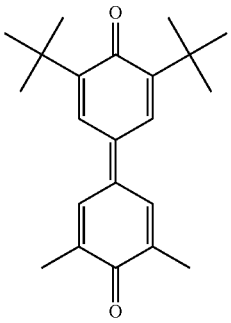

(ETM-1)

(9)

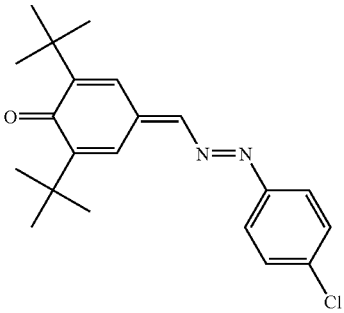

(ETM-2)

(10)

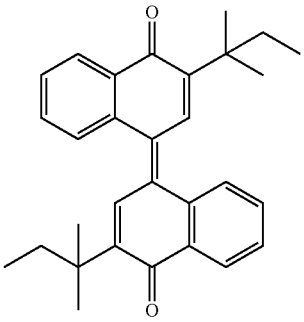

(ETM-3)

(3)-3 Content

It is preferable to adjust the addition quantity of the electron transfer agent to a value within the range from 10 to 100 parts by weight based on 100 parts by weight of the binding resin.

A reason of this is that if the addition quantity of the electron transfer agent becomes a value less than 10 parts by weight, problems in practical use may arise due to lowering of sensitivity, while on the other hand, if the addition quantity of the electron transfer agent is a value exceeding 100 parts by weight, the electron transfer agent will easily crystallize too much and it may be difficult to form a film proper as a photosensitive layer.

It therefore is preferable to adjust the addition quantity of the electron transfer agent to a value within the range from 20 to 80 parts by weight.

In determination of the addition quantity of the electron transfer agent, it is desirable to take into consideration the addition quantity of the hole transfer agent. More specifically, it is desirable to adjust the addition proportion (total ETM/total HTM) of the electron transfer agent (total ETM) to a value within the range from 0.25 to 1.3 based on the hole transfer agent (total HTM).

The reason for this is that if the total ETM/total HTM ratio is a value out of the range, problems in practical use may arise due to lowering of sensitivity.

It therefore is more desirable to adjust the total ETM/total HTM ratio to a value within the range from 0.5 to 1.25.

(4) Charge Generating Agent (4)-1 Kind

As the charge generating agent to be used for the electrophotographic photoconductor of the invention, conventional charge generating agents may be used.

Examples thereof include a single sort or a mixture of two or more sorts selected from organic photoconductors including a phthalocyanine pigment, a perylene pigment, a bisazo pigment, a dioketo-pyrrolopyrrole pigment, a metal-free naphthalocyanine pigment, a metal naphthalocyanine pigment, a squaraine pigment, a trisazo pigment, an indigo pigment, an azulenium pigment, a cyanine pigment, a pyrylium pigment, an anthanthrone pigment, a triphenylmethane pigment, a indanthrene pigment, a toluidine pigment, a pyrazoline pigment and a quinacridone pigment; and inorganic photoconductors including selenium, selenium-tellurium, selenium-arsenic, cadmium sulfide and amorphous silicon.

(4)-2 Specific Examples

Specifically, among such charge generating agents, use of phthalocyanine pigments (CGM-A to CGM-D) represented by the following formulas (11) to (14) are more preferred.

(11)

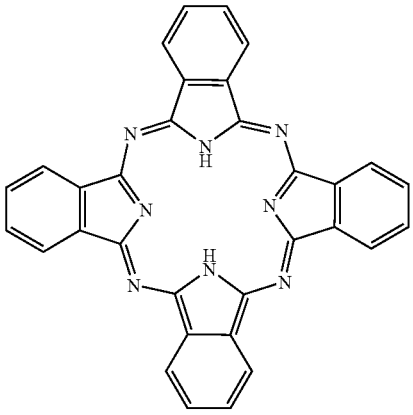

(CGM-A)

(12)

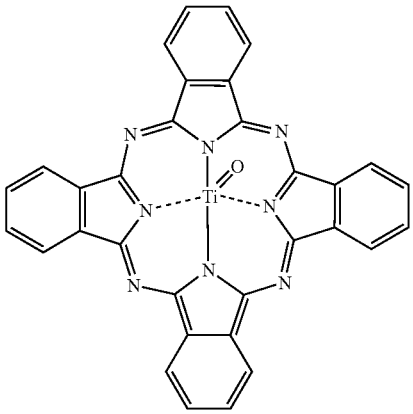

(CGM-B)

-continued (13)

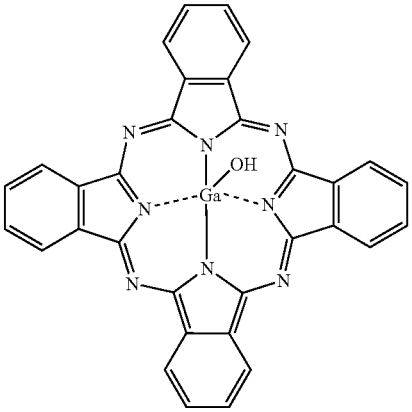

(CGM-C)

(14)

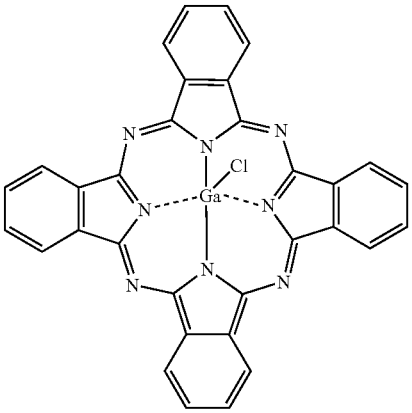

(CGM-D)

(4)-3 Content

It is preferable to adjust the content of the charge generating agent to a value within the range from 0.2 to 40 parts by weight based on 100 parts by weight of the binding resin.

A reason of this is that if the content of the charge generating agent becomes a value less than 0.2 parts by weight, the effect in improving the quantum yield will become insufficient and it therefore will become impossible to increase the sensitivity, electrical characteristics, stability, etc. Another reason is that if the content of the charge generating agent becomes a value greater than 40 parts by weight, the effect in increasing the absorption coefficient to the light having a wavelength in the red color region, the near infrared region or the infrared region in visible light will become insufficient and it therefore may become impossible to increase the sensitivity, electrical characteristics, stability, etc of the photoconductor.

It therefore is more preferable to adjust the content of the charge generating agent to a value within the range from 0.5 to 20 parts by weight.

(5) Additives

As additives, various conventionally known additives may be incorporated unless the electrophotographic properties are affected. Examples thereof include antidegrading agents such as antioxidants, radical scavengers, singlet quenchers and UV absorbers, softeners, plasticizers, surface modifiers, extenders, thickeners, dispersion stabilizers, waxes, acceptors and donors. In order to improve the sensitivity of the photosensitive layer, conventional sensitizers such as terphenyl, halonaphthoquinones and acenaphthylene may be used in combination with the charge generating agent.

(6) Thickness

It is preferable to adjust the thickness of the photosensitive layer to a value within the range from 5 to 50 μm.

A reason for this is that if the thickness of the photosensitive layer is a value less than 5 μm, not only the mechanical strength of the photosensitive layer decreases, but also it may become difficult to form the photosensitive layer uniformly. Another reason is that if the thickness of the photosensitive layer is a value greater than 50 μm, the photosensitive layer may peel off easily from the base body.

Still another reason is that when the thickness of the photosensitive layer is a value within such a range, mechanical degradation or the like can be controlled effectively even if the outer diameter of the electrophotographic photoconductor is made comparatively small or the electrophotographic photoconductor is rotated at a high speed. Therefore, it is possible to control more effectively the occurrence of variation in sensitivity among a plurality of electrophotographic photoconductors due to the light degradation of a photosensitive layer.

For such reasons, it is more desirable to adjust the thickness of the photosensitive layer to a value within the range from 8 to 40 μm, and even more desirably to a value within the range from 10 to 30 μm.

(7) Production Method

A method for producing a monolayer-type electrophotographic photoconductor is not particularly restricted. It can be produced, for example, by the following procedures.

First, an application liquid is prepared by adding a charge generating agent, a charge transfer agent, a binding resin, an additive, etc. to a solvent. The resultant application liquid is applied to a conductive base material (aluminum base tube) by an application method such as dip coating, spray coating, bead coating, blade coating and roller coating.

Subsequently, the base material is, for example, hot air dried at 110° C. for 30 minutes to obtain a monolayer-type electrophotographic photoconductor having a photosensitive layer with a predetermined thickness.

Various organic solvents may be used as a solvent for use in the preparation of the dispersion. Examples thereof include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, chloroform, carbon tetrachloride and chlorobenzene; ethers such as dimethyl ether, diethyl ether, tetrahydrofuran, ethylene glycol dimethyl ether, diethylene glycol dimethyl ether, 1,3-dioxolane and 1,4-dioxane; ketones such as acetone, methyl ethyl ketone and cyclohexanone; esters such as ethyl acetate and methyl acetate; dimethylformaldehyde, dimethylformamide and dimethyl sulfoxide. Such solvents may be used solely or as a mixture of two or more species. A surfactant, a leveling agent or the like may be incorporated in order to improve the dispersibility of the charge generating agent and the smoothness of the surface of the photosensitive layer.

Furthermore, it is also desirable to form an intermediate layer on the base body before forming the photosensitive layer.

In forming such an intermediate layer, it is desirable to prepare an application liquid by dispersing and mixing a binding resin and, if needed, an additive (organic fine powder or inorganic fine powder) with a proper dispersion medium by a conventional method, such as a roll mill, a ball mill, an attritor, a paint shaker and a ultrasonic dispersing machine.

The intermediate layer can be formed by applying the application liquid with a conventional method such as a blade method, an immersion method or a spray method, followed by heat treatment.

For the purpose of generating light scattering to prevent generation of interference fringes, it is also desirable to add various additives (organic fine powder or inorganic fine powder) into the application liquid for the intermediate layer unless sedimentation or the like during the production becomes a problem.

Then, the resultant application liquid for a photosensitive layer may be applied to a supporting base body (aluminum base tube) by an application method, such as dip coating, spray coating, bead coating, blade coating and roller coating, according to known production methods.

The subsequent step of drying the application liquid on the base body is preferably performed at a temperature from 20 to 200° C. for a time from 5 minutes to 2 hours. Therefore, a predetermined photosensitive layer can be formed on the supporting base body (aluminum base tube) in such a way.

(8) Multilayer-Type Electrophotographic Photoconductor

Figure 3A:
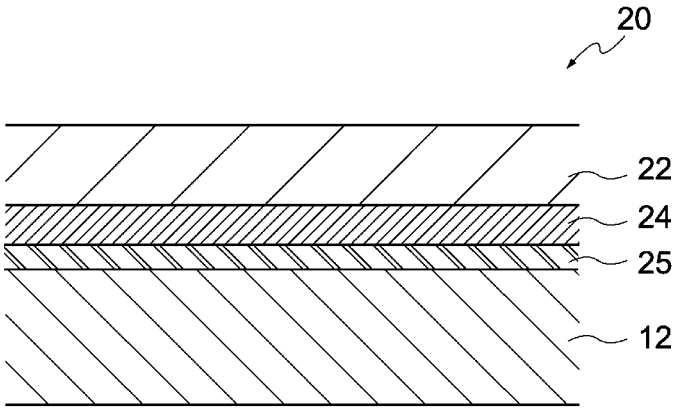
FIGS. 3A and 3B are views for illustrating a fundamental structure of a multilayer-type electrophotographic photoconductor and a modified structure thereof.

In constituting an electrophotographic photoconductor of the invention, it is also desirable that the photosensitive layer be a multilayer-type photosensitive layer 20 including a charge generating layer 24 containing a charge generating agent and a charge transfer layer 22 containing a charge transfer agent and a binding resin as illustrated in FIG. 3A.

This multilayer-type electrophotographic photoconductor 20 can be prepared as follows. A charge generating layer 24 containing a charge generating agent is formed on a base body 12 by means such as vapor deposition or application. Subsequently, an application liquid containing a charge transfer agent and a binding resin is applied on the charge generating layer 24, and then dried to form a charge transfer layer 22.

Figure 3B:
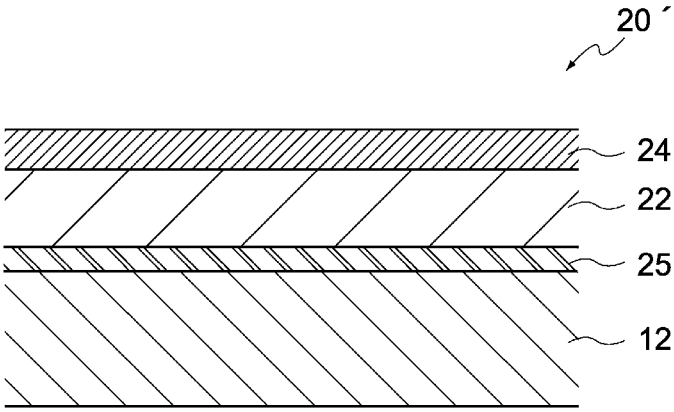

Contrary to the structure mentioned above, it is also permitted that the charge transfer layer 22 is formed on the base body 12 and then the charge generating layer 24 is formed thereon as shown in FIG. 3B. The charge generating layer 24 is extremely thin in comparison to the charge transfer layer 22. Therefore, for the purpose of protecting that layer, it is more desirable that the charge transfer layer 22 is formed on the charge generating layer 24 as shown in FIG. 3A.

It is also desirable to form an intermediate layer 25 on a base body as in the case of a monolayer-type photoconductor.

There is an advantage with adoption of such a multilayer-type photosensitive layer that there are wide variety of options of photosensitive materials such as charge generating agents and charge transfer agents and flexibility in structural design can be improved.

The application liquid for forming a charge generating layer and the application liquid for forming a charge transfer layer can be prepared, for example, by dispersing and mixing predetermined ingredients such as a charge generating agent, a charge transfer agent and a binding resin with a dispersion medium using a roll mill, a ball mill, an attritor, a paint shaker, an ultrasonic dispersion machine, or the like.

In the multilayer-type photosensitive layer 20, the thicknesses of the photosensitive layers (the charge generating layer and the charge transfer layer) are not particularly limited. However, the thickness of the charge generating layer is desirably adjusted to a value within the range from 0.01 to 5 μm, and more desirably to a value within the range from 0.1 to 3 μm. On the other hand, the thickness of the charge transfer layer is desirably adjusted to a value within the range from 2 to 40 μm, and more desirably to a value within the range from 5 to 30 μm.

It is desirable to adjust the content of the charge transfer agent to a value within the range from 10 to 500 parts by weight based on 100 parts by weight of the binding resin in the charge transfer layer.

A reason of this is that by adjusting the content of the charge transfer agent into such a range, it is possible to effectively prevent the charge transfer agent from crystallizing in the charge transfer layer and also obtain superior electrical characteristics.

It is preferable to adjust the content of the charge transfer agent to a value within the range from 25 to 200 parts by weight based on 100 parts by weight of the binding resin in the charge transfer layer.

It is desirable to adjust the content of the charge generating agent in the charge generating layer to a value within the range from 5 to 1000 parts by weight, and more desirably to a value within the range from 30 to 500 parts by weight based on 100 parts by weight of the binding resin in the charge generating layer.

3. Outer Diameter

It is desirable to adjust the outer diameter of the electrophotographic photoconductor to a value within the range from 10 to 30 mm.

A reason for this is that by adjustment of the outer diameter of the electrophotographic photoconductor to a value within such a range can contribute to miniaturization and weight reduction of the electrophotographic photoconductor.

In other words, that is because when the outer diameter of the electrophotographic photoconductor is a value less than 10 mm, the rotation speed of the electrophotographic photoconductor will increase too much and therefore it may become difficult to control the variation in sensitivity among a plurality of electrophotographic photoconductors.

On the other hand, when the outer diameter of the electrophotographic photoconductor becomes a value over 30 mm, it will become difficult to contribute to the miniaturization and weight reduction of the electrophotographic photoconductor.

For such reasons, it is more desirable to adjust the outer diameter of the electrophotographic photoconductor to a value within the range from 12 to 28 mm, and even more desirably to a value within the range from 15 to 25 mm.

4. Sensitivity Ratio

The electrophotographic photoconductor of the invention is characterized in that the sensitivity ratio represented by Vb/Va is adjusted to a value of below 2 wherein Vb (V) denotes a sensitivity in the case where an amount of light exposure per unit area is 0.6 $\mu J/cm^2$ and Va (V) denotes a sensitivity in the case where an amount of light exposure per unit area is 1.5 $\mu J/cm^2$.

The reason for this is that by controlling the ratio of the sensitivities measured at at least two predetermined amounts of light exposure (per unit area), it is possible to effectively control the variation in sensitivity among a plurality of electrophotographic photoconductors and obtain a high sensitivity even when the exposure/development times are shortened, for example, when the rotation speed of the electrophotographic photoconductor becomes 70 rpm or more.

Therefore, even when it is mounted in a tandem-system color image forming device and image formation is performed at a high speed, the image density is stable among a plurality of electrophotographic photoconductors and high quality color images can be formed at each photoconductor for a long period of time.

The reason for controlling the ratio of the sensitivities measured at at least two predetermined amounts of light exposure (per unit area) will be described in detail below.

That is, when only the sensitivity (light potential) Va at the time of adjusting the amount of light exposure per unit area to 1.5 μJ/cm$^2$ is used as the criterion for evaluating the sensitivity behavior of an electrophotographic photoconductor, it can be considered as a saturated light potential in the electrophotographic photoconductor because the light potential is a light potential at a sufficient amount of light exposure.

However, in use of an electrophotographic photoconductor in a tandem-system color image forming device, there was a problem that it became difficult to fully evaluate the sensitivity behavior according to such an evaluation criterion.

More specifically, in a tandem-system color image forming device, a usage mode is adopted in which a plurality of electrophotographic photoconductors are used simultaneously. In this case, the variation in sensitivity among such a plurality of electrophotographic photoconductors greatly influences the quality and density of images of four color toners. In addition, such variation in sensitivity becomes a more remarkable problem when the exposure/development times become short in high-speed image formation.

In the present invention, on the other hand, in addition to the sensitivity (light potential) Va (V) in the case of adjusting the amount of light exposure per unit area to 1.5 μJ/cm$^2$, the sensitivity (light exposure) Vb (V) in the case of adjusting the amount of light exposure per unit area to 0.6 μJ/cm$^2$ is also measured and the sensitivity ratio represented by Vb/Va is adjusted to a value of below 2. It therefore is possible to control the variation in sensitivity among a plurality of electrophotographic photoconductors even when the amount of light exposure substantially varies.

In other words, by regulating the ratio of the light potential at a relatively small amount of light exposure and a saturated light potential in the electrophotographic photoconductor into a predetermined range, it is possible to obtain an almost saturated stable light potential in individual electrophotographic photoconductors even when the substantial amount of light exposure changes.

Therefore, the sensitivity ratio represented by Vb/Va is more desirably adjusted to a value within the range from 1 to 1.8, and even more preferably to a value within the range from 1 to 1.5, wherein Vb (V) denotes a sensitivity in the case where an amount of light exposure per unit area is 0.6 μJ/cm$^2$ and Va (V) denotes a sensitivity in the case where an amount of light exposure per unit area is 1.5 μJ/cm$^2$.

Regarding the amount of light exposure per unit area (Ic) to the photoconductor at the time of actually forming a color image, the amount of light exposure per unit area (Ic) desirably is a value between the amount of light exposure per unit area (Ib=0.6 μJ/cm$^2$) and the amount of light exposure per unit area (Ia=1.5 μJ/cm$^2$), or a value substantially equal to or a little smaller than the amount of light exposure per unit area (Ib).

A reason for this is that even if the amount of light exposure per unit area (Ic) varies to some extent, it is easy to obtain a predetermined sensitivity certainly if the Ic is a value between the amount of light exposure per unit area (Ib) and the amount of light exposure per unit area (Ia). Another reason is that a predetermined sensitivity can be obtained easily and it has been confirmed that photoconductors can be prevented from light degradation more effectively even when the amount of light exposure per unit area (Ic) is substantially equal to the amount of light exposure per unit area (Ib) (for example, from 90 to 100% of Ib) or is a value a little smaller than the Ib (for example, not less than 70% but less than 90% of Ib).

Next, a relationship among the sensitivity ratio mentioned above, the variation in sensitivity and the image density will be described with reference to FIG. 1.

In FIG. 1, a characteristic curve A and a characteristic curve B are shown. The sensitivity ratio (–) represented by Vb/Va is taken in abscissa wherein Vb (V) denotes a sensitivity in the case where an amount of light exposure per unit area is 0.6 μJ/cm$^2$ and Va (V) denotes a sensitivity in the case where an amount of light exposure per unit area is 1.5 μJ/cm$^2$. The characteristic curve A is obtained by taking the variation in sensitivity (V) in ordinate, and the characteristic curve B is obtained by taking the image density (–) in ordinate.

The details about the method of measuring the sensitivity, the method of calculating the variation in sensitivity, the method of measuring the image density and the like are described in Examples provided below.

First, as understood from the characteristic curve A, the variation in sensitivity increases with increase in sensitivity ratio.

More specifically, in the range where the sensitivity ratio is below 2, the variation in sensitivity increases gradually with increase in sensitivity ratio, but values of 20 V or less are maintained with stability. On the other hand, it is understood that when the sensitivity ratio becomes a value of 2 or more, the variation in sensitivity starts to increase rapidly with increase in sensitivity ratio. For example, it is found that when the sensitivity ratio is 2.2, the variation in sensitivity increases rapidly to a value of 40 V or more.

Next, as understood from the characteristic curve B, the image density decreases at an almost constant rate with increase in sensitivity ratio.

The image density is maintained at values of 1.3 or more when the sensitivity ratio is in the range of below 2, while the image density is a value of below 1.3 when the sensitivity ratio is within the range of not less than 2. It therefore is understood that it becomes difficult to obtain sufficient image densities with stability.

Therefore, as can be understood from the characteristic curves A and B, the sensitivity ratio represented by Vb/Va is adjusted to a value of below 2 wherein Vb (V) denotes a sensitivity in the case where an amount of light exposure per unit area is 0.6 μJ/cm$^2$ and Va (V) denotes a sensitivity in the case where an amount of light exposure per unit area is 1.5 μJ/cm$^2$, whereby it is possible to critically control the variation in sensitivity and also to effectively control the decrease of image density.

In other words, it is understood that adjusting the sensitivity value to a value of below 2 allows control of the variation in sensitivity and also in image density among a plurality of electrophotographic photoconductors to form high-quality color images even when a tandem-system color image formation is performed using a plurality of electrophotographic photoconductors.

The sensitivity ratio mentioned above will be described more concretely with reference to FIG. 4.

Figure 4:
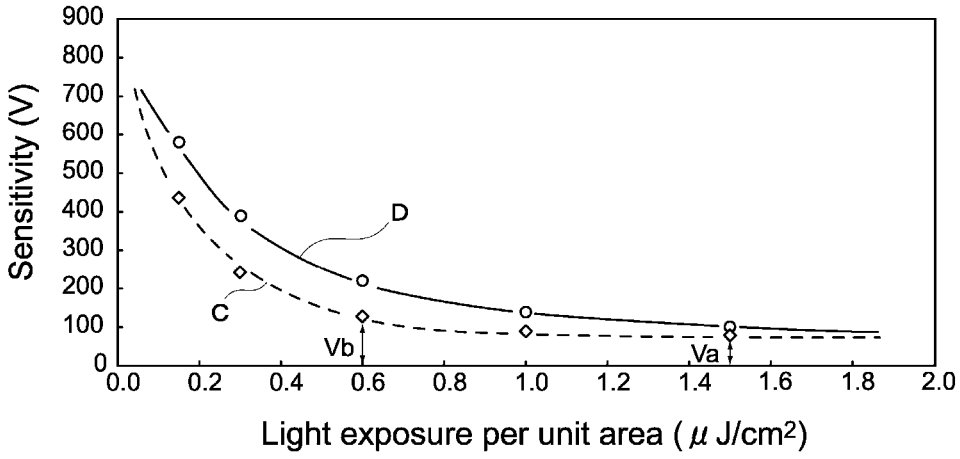
FIG. 4 is a graph for illustrating a relationship between an amount of light exposure per unit area and a sensitivity.

In FIG. 4 shown are characteristic curves C and D taking the amount of light exposure per unit area (μJ/cm$^2$) in abscissa and the sensitivity (V) in ordinate.

The characteristic curve C is a characteristic curve of the case where the sensitivity ratio is below 2 and characteristic curve D is a characteristic curve of the case where the sensitivity ratio is 2 or more.

In other words, as can be understood from the characteristic curves C and D, the value of the sensitivity decreases and clearer electrostatic latent images can be formed as the value of the amount of light exposure per unit area becomes greater.

However, in some electrophotographic photoconductors, the value of the sensitivity may vary greatly depending upon the amount of light exposure per unit area as shown in the characteristic curve D. In such a case, the value of the sensitivity changes greatly and it becomes difficult to control the variation in sensitivity among a plurality of electrophotographic photoconductors when the substantial amount of light exposure changes.

On the other hand, in some electrophotographic photoconductors, the value of the sensitivity may be relatively stable regardless of the amount of light exposure per unit area as shown in the characteristic curve C. In this case, it is possible to control the change of the sensitivity even when the substantial amount of light exposure changes. Therefore, the variation in sensitivity among a plurality of electrophotographic photoconductors can be controlled effectively.

In other words, for the reasons described above, the sensitivity ratio measured at two predetermined amounts of light exposure (per unit area) is controlled in the present invention.

It is desirable to adjust the sensitivity (Vb) at the time when the amount of light exposure per unit area is adjusted to 0.6 $\mu J/cm^2$ to a value 150 V or less.

The reason for this is that the sensitivity (Vb) at the time when the amount of light exposure per unit area is adjusted to 0.6 $\mu J/cm^2$ is adjusted to a value within such a range, so that a high sensitivity can be certainly obtained even when the amount of light exposure is small.

In other words, that is because by adjusting the light potential at a relatively small amount of light exposure to a value within such a range, it is possible to obtain a stable fully-saturated light potential even when the substantial amount of light exposure decreases.

Therefore, the sensitivity (Vb) in the case where the amount of light exposure per unit area is adjusted to 0.6 $\mu J/cm^2$ is more preferably adjusted to a value within the range from 120 to 145 V, and even more preferably to a value within the range from 125 to 140 V.

It is desirable to adjust the sensitivity (Va) at the time when the amount of light exposure per unit area is adjusted to 1.5 $\mu J/cm^2$ to a value within the range from 70 to 120 V.

The reason for this is that by adjusting the sensitivity (Va) when the amount of light exposure per unit area is adjusted to 1.5 $\mu J/cm^2$ to a value within such a range, it is possible to control the variation in sensitivity easily even when the amount of light exposure substantially varies among a plurality of photoconductors.

In other words, that is because by adjusting the light potential in a saturated condition to a value within such a range, it is possible to control the variation in light potential to obtain a stable light potential even when the substantial amount of light exposure decreases.

Therefore, the sensitivity (Va) in the case where the amount of light exposure per unit area is adjusted to 1.5 $\mu J/cm^2$ is more preferably adjusted to a value within the range from 75 to 115 V, and even more preferably to a value within the range from 80 to 110 V.

Second Embodiment

A second embodiment is a tandem-system color image forming device including a drum type electrophotographic photoconductor, a rotation speed of which is 70 rpm or more, wherein the color image forming device is provided with a positive charging type electrophotographic photoconductor and when Vb (V) denotes a sensitivity in the case where an amount of light exposure per unit area of the electrophotographic photoconductor is 0.6 $\mu J/cm^2$ and Va (V) denotes a sensitivity in the case where an amount of light exposure per unit area is 1.5 $\mu J/cm^2$, a sensitivity ratio represented by Vb/Va is adjusted to a value of below 2.

Hereinbelow, the color image forming device as the second embodiment will be described focusing on differences from the contents described in the first embodiment.

Figure 5:
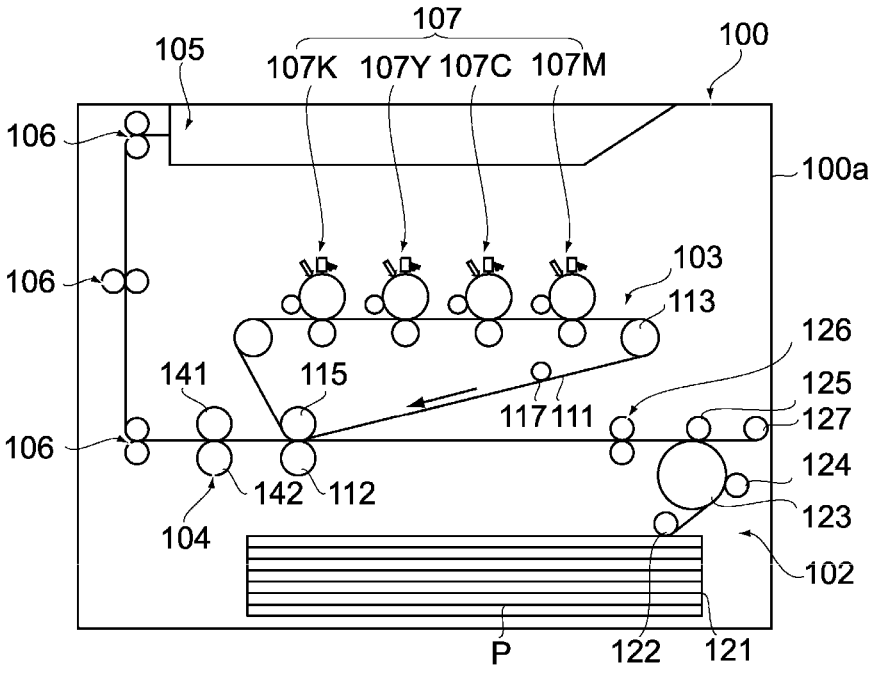
FIG. 5 is a diagram for illustrating a tandem-system image forming device (No 1)
Figure 6:
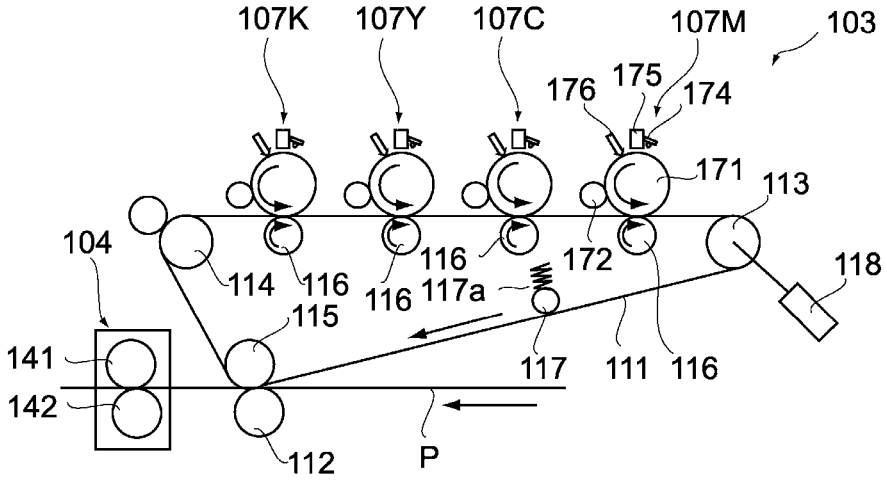
FIG. 6 is a diagram for illustrating a tandem-system image forming device (No 2).

First, the color image forming device of the second embodiment is, for example, an entire configuration of a color printer 100 as shown in FIG. 5. FIG. 6 is an enlarged major portion diagram illustrating the structure surrounding an image transfer part 103 of the color printer 100 shown in FIG. 5. First, with reference to FIGS. 5 and 6, the entire configuration of the tandem-type color printer 100, which is the first embodiment of the present invention, will be described.

This color printer 100 has a box-shaped instrument body 100*a* as shown in FIG. 5. In the instrument body 100*a* provided are a paper feeding portion 102, an image transfer portion 103, and a fixing part 104. The paper feeding portion 102 feeds a paper sheet P. The image transfer portion 103 transfers an image to the paper sheet P while conveying the paper sheet P fed from the paper feeding portion 102. The fixing part 104 applies fixing treatment to the image transferred to the paper sheet P in the image transfer portion 103. On the top surface of the instrument body 100*a*, a paper ejection part 105, from which a paper sheet P subjected to fixing treatment in the fixing part 104, is provided.

The paper feeding portion 102 is equipped with a paper feeding cassette 121, a pickup roller 122, paper feeding rollers 123, 124, 125 and a resist roller 126. The paper feeding cassette 121 is provided so as to be insertable to and removable from the instrument body 100*a* and stores paper sheets P of various sizes. The pickup roller 122 is provided at the right upper position of the paper feeding cassette 121 and picks up the paper sheets P stored in the paper feeding cassette 121 one after another. The paper feeding rollers 123, 124 and 125 send out the paper sheets P picked up by the pickup roller 122 to a paper conveying path. The resist roller 126 has a function of causing a paper sheet P sent out to the paper conveying path by the paper feeding rollers 123, 124 and 125 to wait temporarily and then feeding it into the image transfer portion 103 at a predetermined timing.

The paper feeding portion 102 further includes a detachable tray (not shown) to be mounted to the right side of the instrument body 100*a* and a pickup roller 127. The pickup roller 127 has a function of taking out a paper sheet P laid in the detachable tray. Therefore, the paper sheet P taken out by the pickup roller 127 is sent out to the paper conveying path by the paper feeding rollers 123 and 125 and then is fed to the image transfer portion 103 at a predetermined timing by the resist roller 126.

The image transfer portion 103 is equipped with an image transfer unit 107, an intermediate transfer belt 111, and a secondary transfer roller 112. To the surface (contact surface) of the intermediate transfer belt 111, a toner image is primarily transferred by the image transfer unit 107. The secondary transfer roller 112 secondarily transfers the toner image on the intermediate transfer belt 111 to the paper sheet P fed from the paper feeding cassette 121.

The image transfer unit 107 comprises a black unit 107K, a yellow unit 107 Y, a cyan unit 107C and a magenta unit 107M arranged in order from the upstream side (the left side in FIG. 5) towards the downstream side.

At the central position of each of the units 107K, 107Y, 107C and 107M, a photoconductor drum 171 as an image carrier is arranged rotatably in the direction of the arrow (counter clockwise). A charger 175, an exposure device 176, a developing device 172, a discharger 174 and the like are arranged around each photoconductor drum 171 in order from the upstream side in the direction of rotation.

In FIGS. 5 and 6, no cleaning device is provided.

The charger 175 has a function of uniformly charging the peripheral surface of the photoconductor drum 171 in rotation along the direction of the arrow. Examples of such a charger 175 include scorotron chargers.

The exposure device 176 is a kind of laser scanning unit. It has a function of irradiating the peripheral surface of the photoconductor drum 171 uniformly charged by the charger 175 with laser lights based on the image data inputted from an image reader or the like and thereby forming an electrostatic latent image based on the image data on the photoconductor drum 171.

The developing device 172 has a function of forming a toner image base on image data by supplying a toner to the peripheral surface of the photoconductor drum 171 on which an electrostatic latent image has been formed. The toner image is primarily transferred to the intermediate transfer belt 111.

The discharger 174 has a function of discharging the peripheral surface of the photoconductor drum 171 after the completion of the primary transfer. Therefore, the peripheral surface of the photoconductor drum 171 which has been discharged by the discharger 174 moves toward the charger 175 for new charging treatment and is subjected to new charging.

The intermediate transfer belt 111 is an endless belt-shaped rotating member. It is entrained about a plurality of rollers including the driving roller 113, the belt supporting roller 114, the backup roller 115, the primary transfer roller 116 and the tension roller 117 so that the front surface (contact surface) thereof comes into contact with the peripheral surface of each photoconductor drum 171.

The intermediate transfer belt 111 is configured so as to be endlessly rotated by a plurality of rollers while being pressed against each photoconductor drum 171 by a primary transfer roller 116 arranged facing the photoconductor drum 171.

The driving roller 113 is rotated by a driving source 118 such as a stepping motor and provides a driving force for endlessly rotating the intermediate transfer belt 111. Therefore, the driving roller 113 is desirably a roller having an elastic material layer made of urethane rubber or the like on its surface. This makes it possible to drive such an intermediate transfer belt 111 without damaging the rear surface of the intermediate transfer belt 111.

The belt supporting roller 114, the backup roller 115, the primary transfer roller 116 and the tension roller 117 are driven rollers which are provided freely rotatably and rotate in association with the endless rotation of the intermediate transfer belt 111 by the driving roller 113.

These driven rollers 114, 115, 116 and 117 each are rotated via the intermediate transfer belt 111 in association with the driving rotation of the driving roller 113 and have a function of supporting the intermediate transfer belt 111.

Furthermore, the tension roller 117 and the primary transfer roller 116 function in the following manners.

First, the tension roller 117 gives a tension to the intermediate transfer belt 111 so that the intermediate transfer belt does not slacken. The tension belt 117 is urged by an urging member 117*a* or the like such as a spring thereby to generate a tension by applying a pressing force to the intermediate transfer belt 111 from the rear side (inner peripheral side) of the intermediate transfer belt 111 toward the surface (outer peripheral side).

On the other hand, the primary transfer roller 116 applies a primary transfer bias, which has an polarity opposite to the electrification polarity of a toner, to the intermediate transfer belt 111. By doing so, the toner images formed on the photoconductor drums 171 are transferred (primarily transferred) one after another between each photoconductor drum 171 and the primary transfer roller 116 due to the drive of the driving roller 113, with the result of a state where they are in layers on the intermediate transfer belt 111 rotating in the direction of the arrow (clockwise).

As the driven rollers 114, 115, 116 and 117, for example, metal rollers at least having a surface made of metal and rubber rollers having a surface made of an elastic material are used. As at least one of the driven rollers 114, 115, 116 and 117, a metal roller is used. In addition, it is desirable that the driven roller (primary transfer roller) 116 be an electroconductive rubber roller.

The secondary transfer roller 112 applies to a paper sheet P a secondary transfer bias having a polarity opposite to that of the toner images. By doing so, the toner image primarily transferred to the intermediate transfer belt 111 is transferred to the paper sheet P between the secondary transfer roller 112 and the backup roller 115 and, as a result, a transferred color image is formed on the paper sheet P.

The fixing part 104 applies fixing treatment to the transferred image transferred to the paper sheet P in the image transfer portion 103, and has a heating roller 141 and a pressing roller 142. The heating roller 141 is heated with an electrically heat-generating body. The pressing roller 142 is arranged facing the heating roller 141 and the peripheral surface thereof is pressed against the peripheral surface of the heating roller 141.

The transferred image transferred to the paper sheet P in the image transfer portion 103 by the secondary transfer roller 112 is fixed to the paper sheet P through fixing treatment by heating when the paper sheet P passes between the heating roller 141 and the pressing roller 142. The paper sheet P subjected to the fixing treatment is ejected to the paper ejection part 105. In the color printer 101 of this embodiment, conveying rollers 106 are allocated in proper places between the fixing part 104 and the paper ejection portion 105.

The image forming device of the invention is characterized in that a rotation speed of an electrophotographic photoconductor is adjusted to a value of 70 rpm or more.

The reason for this is that the image forming device of the invention can produce high-quality color images at high speed while effectively controlling the variation in sensitivity among a plurality of electrophotographic photoconductors even when the rotation speed of the electrophotographic photoconductors is adjusted within such a range.

Therefore, the rotation speed of the electrophotographic photoconductor is more preferably adjusted to a value within the range from 75 to 100 rpm, and even more preferably to a value within the range from 80 to 90 rpm.

In constituting the color image forming device of the invention, it is desirable to adjust the process speed to a value within the range from 80 to 200 mm/sec.

The reason for this is that by adjusting the process speed to a value within such a range, it is possible to perform image formation at high speed to improve the image formation efficiency. When the process speed is increased, the exposure/development times are shortened. However, use of the electrophotographic photoconductor of the invention makes it possible to control the variation in sensitivity among a plurality of electrophotographic photoconductors and also possible to obtain a high sensitivity.

Therefore, the process speed is more preferably adjusted to a value within the range from 90 to 150 mm/sec, and even more desirably to a value within the range from 100 to 120 mm/sec.

In constituting the color image forming device of the invention, it is preferable that the device be in a cleaner-less system.

Adoption of such a constitution in which cleaner blades or the like are omitted can contribute to miniaturization and weight reduction of color image forming devices.

In the case of a conventional color image forming device, adoption of a cleaner-less system causes a large amount of toner to remain on an electrophotographic photoconductor and, as a result, substantial variation in the amount of light exposure tends to occur. However, the electrophotographic photoconductor of the invention can control the variation in sensitivity among a plurality of electrophotographic photoconductors, even if it is in a cleaner-less system. Therefore, a high sensitivity can be obtained even when a large amount of toner remains on the electrophotographic photoconductor, with the result that the amount of light exposure varies.

EXAMPLES

Example 1

1. Preparation of Electrophotographic Photoreceptor

In a container, charged were 100 parts by weight of a polycarbonate resin (Resin-1) having a viscosity average molecular weight of 30,000 represented by formula (1) as a binding resin, 4 parts by weight of an X-type non-metal phthalocyanine (CGM-A) represented by formula (11) as a charge generating agent, 80 parts by weight of a compound (HTM-1) represented by formula (2) as a hole transfer agent, 30 parts by weight of a compound (ETM-1) represented by formula (8) as an electron transfer agent, and 800 parts by weight of tetrahydrofuran as a solvent.

Subsequently, the mixture was mixed and dispersed for 50 hours with a ball mill to prepare an application liquid for a monolayer-type photosensitive layer. The resultant application liquid was applied by dip coating to a base body (aluminum base tube) 254 mm in length and 24 mm in diameter, and then dried in hot air at 110° C. for 30 minutes. Thus, an electrophotographic photoconductor having a monolayer-type photosensitive layer 30 μm in thicknesses was obtained.

Under the same conditions as above, 100 electrophotographic photoconductors were produced.

2. Evaluation of Electrophotographic Photoreceptor

1) Measurement of Sensitivity

The sensitivities of the electrophotographic photoconductors obtained (the number of measurements=100) were measured under the following conditions.

Using a drum sensitivity tester (CYNTHIA30M produced by GENTEC Co.), the surface of the electrophotographic photoconductor was irradiated for 40 msec with monochromatic light having a wavelength of 780 nm (half value width: 20 nm) isolated by a bandpass filter from white light of a halogen lamp while the electrophotographic photoconductor was kept charged to a surface potential of +800 V. The amount of light exposure per unit area was adjusted to 0.6 μJ/cm$^2$. Subsequently, surface potentials (Vb) at the time when 300 msec had passed since the start of the exposure were measured and then the average value (the number of measurement=100) was calculated from the measurements.

Thereafter, surface potentials (Va) at the time when 300 msec had passed since the start of the exposure were measured in the same manner as above except for changing the amount of light exposure per unit area from 0.6 μJ/cm$^2$ to 1.5 μJ/cm$^2$, and then the average value (the number of measurement=100) was calculated from the measurements.

(2) Variation in Sensitivity

Among the measurements of the sensitivity of the electrophotographic photoconductor (the number of measurements:100, the amount of light exposure per unit area: 0.6 μJ/cm$^2$), the average of the top 20 measurements with respect to surface potential is defined as the maximum ($V_{max}$) and the bottom 20 measurements with respect to surface potential is defined as the minimum ($V_{min}$). Then, the variation in sensitivity (V) was calculated as shown below.

$$\text{Variation in sensitivity } (V) = \text{Maximum } (V_{max}) - \text{Minimum } (V_{min})$$

(3) Image Density

The electrophotographic photoconductor (the number of measurement=100) was mounted in a modified machine of KM-C3232 produced by KYOCERA MITA Corp., and solid image patterns were printed on 10,000 sheets under the condition shown below.

Subsequently, the image density in a solid image pattern obtained after the 10,000-sheet printing was measured using a Macbeth reflection density meter (manufacture by Macbeth Co.).

More specifically, the image densities in solid portions of the solid image pattern were measured and the average value thereof was calculated and used as an image density.

Charging system: Scorotron charging system (charging potential: 800 V)

Exposure system: Laser light source exposure system (amount of light exposure per unit area: 0.5 μJ/cm$^2$)

Development system: Nonmagnetic monocomponent toner (Polymerized toner; only a black type is used.)

Intermediate transfer system: Belt-shaped transfer system

Cleaning blade: None

Process speed: 100 mm/sec

Drum rotation speed: 80 rpm

Examples 2-6 and Comparative Example 1

In Examples 2-6 and Comparative Example 1, electrophotographic photoconductors were produced and evaluated in the same manner as in Example 1 except for changing the kind of the hole transfer agent in the electrophotographic photoconductor as shown in Table 1. The results are shown in Table 1. In Comparative Example 1, a compound (HTM-7) represented by the following formula (15) was used.

(15)

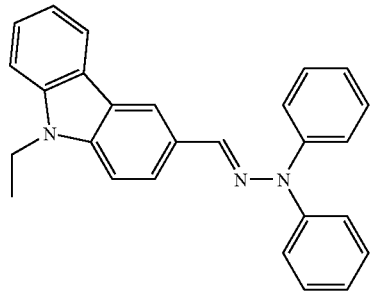

(HTM-7)

Examples 7-8 and Comparative Example 2

In Examples 7-8 and Comparative Example 2, electrophotographic photoconductors were produced and evaluated in the same manner as in Example 2 except for changing the kind of the electron transfer agent in the electrophotographic photoconductor as shown in Table 1. The results are shown in Table 1. In Comparative Example 2, a compound (ETM-4) represented by the following formula (16) was used.

(16)

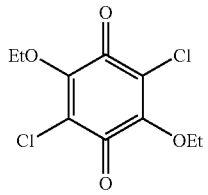

(ETM-4)

TABLE 1

| | Hole transfer agent | Electron transfer agent | Sensitivity (V) Vb | Sensitivity (V) Va | Sensitivity ratio (–) Vb/Va | Image density | Variation in sensitivity (V) $V_{max}$ | Variation in sensitivity (V) $V_{min}$ | Variation in sensitivity (V) $V_{max} - V_{min}$ |
|---|---|---|---|---|---|---|---|---|---|
| Example 1 | HTM-1 | ETM-1 | 148 | 90 | 1.64 | 1.35 | 152 | 144 | 8 |
| Example 2 | HTM-2 | | 130 | 75 | 1.73 | 1.37 | 136 | 124 | 12 |
| Example 3 | HTM-3 | | 137 | 80 | 1.71 | 1.37 | 143 | 131 | 12 |
| Example 4 | HTM-4 | | 132 | 77 | 1.71 | 1.39 | 142 | 124 | 16 |
| Example 5 | HTM-5 | | 186 | 95 | 1.96 | 1.31 | 193 | 178 | 15 |
| Example 6 | HTM-6 | | 165 | 89 | 1.85 | 1.35 | 173 | 160 | 13 |
| Comparative Example 1 | HTM-7 | | 221 | 98 | 2.26 | 1.18 | 241 | 200 | 41 |
| Example 7 | HTM-2 | ETM-2 | 133 | 76 | 1.75 | 1.36 | 140 | 126 | 14 |
| Example 8 | | ETM-3 | 125 | 73 | 1.71 | 1.37 | 131 | 119 | 12 |
| Comparative Example 2 | | ETM-4 | 267 | 121 | 2.21 | 1.11 | 289 | 145 | 44 |

As described in detail above, according to the present invention, the sensitivity ratio represented by Vb/Va is adjusted to a predetermined value wherein Vb (V) denotes a sensitivity in the case where an amount of light exposure per unit area is 0.6 μJ/cm$^2$ and Va (V) denotes a sensitivity in the case where an amount of light exposure per unit area is 1.5 μJ/cm$^2$, so that it has become possible to obtain an electrophotographic photoconductor which shows a small variation in sensitivity and exhibits a high sensitivity even at a small amount of light exposure and a tandem type color image forming device provided with the electrophotographic photoconductor.

Therefore, the electrophotographic photoconductor of the invention and the image forming device including the same are expected to greatly contribute to improvement in light elongation and process speed in various image forming devices such as copying machines and printers and quality improvement of formed images.

What is claimed is:

1. A tandem-system color image forming device including a drum type electrophotographic photoconductor, a rotation speed of which is 70 rpm or more, wherein the color image forming device is provided with a positive charging type electrophotographic photoconductor by which an image density is maintained at a value of 1.3 or more, wherein the electrophotographic photoconductor comprises a photosensitive layer containing a mixture of at least a charge-generating agent, a hole transfer agent, an electron transfer agent, and a binder resin carried on a conductive substrate, the conductive substrate comprising an aluminum base tube, the charge-generating agent comprising an X-type nonmetal phthalocyanine, the binder resin comprising a polycarbonate resin represented by the formula (1)

(1)

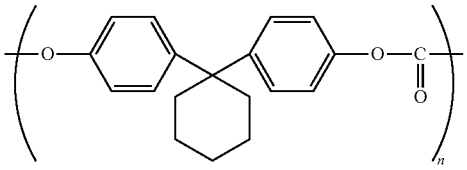

having a viscosity average molecular weight of from 20,000 to 80,000, the hole transfer agent comprising a compound represented by formula (2) or (5), (2)

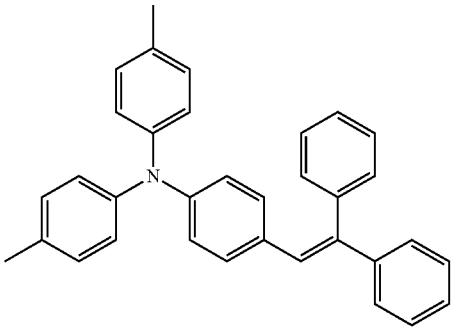

(5)

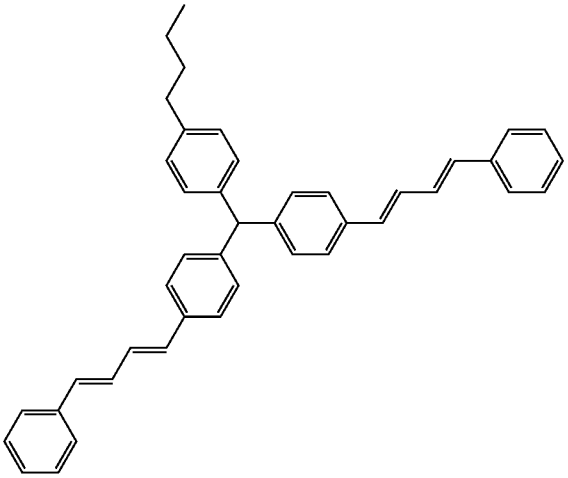

(HTM-4)

the electron transfer agent is comprising a compound represented by the formula (9), (9)

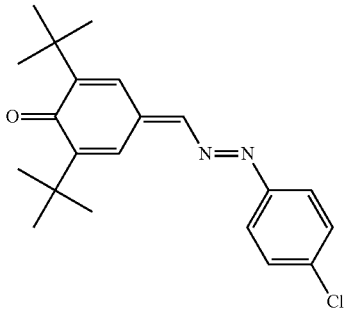

and wherein, when Vb (V) denotes a sensitivity in the case where an amount of light exposure per unit area is 0.6 $\mu J/cm^2$ and Va (V) denotes a sensitivity in the case where an amount of light exposure per unit area is 1.5 $\mu J/cm^2$, a sensitivity ratio represented by (Vb/Va) is adjusted to a value within the range from 1 to 1.73;

wherein the sensitivity (Vb), in the case where the amount of light exposure per unit area is 0.6 $\mu J/cm^2$, is adjusted to a value of 150 V or less, and wherein the sensitivity (Va), in the case where the amount of light exposure per unit area is 1.5 $\mu J/cm^2$, is adjusted to a value within the range from 70 to 120 V.

2. The color image forming device according to claim 1, wherein an outer diameter of electrophotographic photoconductor is adjusted to a value within the range from 10 to 30 mm.

3. The color image forming device according to claim 1, wherein the thickness of the photosensitive layer is adjusted to a value within the range from 5 to 50 μm.

4. The color image forming device according to claim 1, wherein a process speed is adjusted to a value within the range from 80 to 200 mm/sec.

5. The color image forming device according to claim 1, wherein a cleaner-less system is adopted.

6. The color image forming device according to claim 1, wherein the photosensitive layer comprises 0.2 to 40 parts by weight of the charge-generating agent, 10 to 100 parts by weight of the hole transfer agent, and 10 to 100 parts by weight of the electron transfer agent, to 100 parts of the binder resin.

7. The color image forming device according to claim 6, wherein the photosensitive layer comprises 30 to 80 parts by weight of the hole transfer agent.

8. The color image forming device according to claim 6, wherein the photosensitive layer comprises 20 to 80 parts by weight of the electron transfer agent.

9. The color image forming device according to claim 6, wherein the photosensitive layer comprises a ratio of the electron transfer agent to the hole transfer agent of 0.25 to 1.3 by weight.

10. The color image forming device according to claim 9, wherein the photosensitive layer comprises a ratio of the electron transfer agent to the hole transfer agent of 0.5 to 1.25 by weight.

* * * * *